US006763792B2

(12) United States Patent
Okamoto

(10) Patent No.: US 6,763,792 B2
(45) Date of Patent: Jul. 20, 2004

(54) FOUR STROKE ENGINE FOR OUTBOARD MOTOR

(75) Inventor: Yutaka Okamoto, Shizuoka (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 10/290,422

(22) Filed: Nov. 6, 2002

(65) Prior Publication Data

US 2003/0051683 A1 Mar. 20, 2003

Related U.S. Application Data

(62) Division of application No. 09/358,992, filed on Jul. 22, 1999.

(30) Foreign Application Priority Data

Jul. 31, 1998 (JP) ..... 10-218310
Oct. 16, 1998 (JP) ..... 10-295634

(51) Int. Cl.[7] ..... F01L 1/02
(52) U.S. Cl. ..... 123/90.31; 123/90.27
(58) Field of Search ..... 123/90.27, 90.31; 440/88, 89, 900

(56) References Cited

U.S. PATENT DOCUMENTS 4,993,374 A 2/1991 Okui ..... 123/90.31
5,178,108 A 1/1993 Beaber ..... 123/90.31
5,678,516 A * 10/1997 Sakurai ..... 123/198 R
5,704,819 A 1/1998 Isogawa ..... 440/88
5,718,196 A 2/1998 Uchiyama et al. ..... 123/195 C
5,724,930 A 3/1998 Sakurai et al. ..... 123/90.31
5,740,768 A 4/1998 Sakurai et al. ..... 123/90.27
5,865,655 A 2/1999 Hiraoka et al. ..... 440/89
5,873,336 A * 2/1999 Uchida ..... 123/90.31
6,044,817 A * 4/2000 Hiraoka et al. ..... 123/90.31
6,062,927 A * 5/2000 Hiraoka et al. ..... 440/88
6,199,525 B1 * 3/2001 Uema et al. ..... 123/90.31
6,213,829 B1 * 4/2001 Takahashi et al. ..... 440/113

FOREIGN PATENT DOCUMENTS

JP 09041934 A * 2/1997 ..... F01M/11/00
JP 10-2229 1/1998
JP 10008986 A * 1/1998 ..... F02B/67/00

OTHER PUBLICATIONS

US 5,848,578, 12/1998, Uchiyama et al. (withdrawn)

* cited by examiner

*Primary Examiner*—Thomas Denion
*Assistant Examiner*—Ching Chang
(74) *Attorney, Agent, or Firm*—Knobbe, Martens, Olson & Bear LLP

(57) ABSTRACT

An improved four stroke engine for outboard motor having a protective cowling encircling the engine. The four stroke engine has V-shaped banks of cylinders and each bank is provided with a couple of overhead camshafts extending generally vertically. The engine has also a single crankshaft extending generally vertically. The crankshaft has a driving wheel, while each camshaft positioned on the inside of each bank has a driven wheel, which diameter is twice as large as the diameter of the driving wheel. The driven wheels on the camshafts are driven by an endless transmitter wound around the driving wheel and the driven wheels. The other camshafts of the respective banks are driven by the camshafts, which are directly driven by the crankshaft, with drive mechanisms. In another embodiment, both of the camshafts of the respective banks are driven by a couple of intermediate shafts and driven wheels placed on them. The driven wheels on the intermediate shafts are driven by the driving wheel on the crankshaft.

9 Claims, 11 Drawing Sheets

FOUR STROKE ENGINE FOR OUTBOARD MOTOR

PRIORITY INFORMATION

This application is a divisional application of U.S. patent application Ser. No. 09/358,992 filed Jul. 22, 1999, the entire contents of which is hereby expressly incorporated by reference.

BACKGROUND OF THE INVENTION

1. Field of the Invention

This invention relates to a four stroke engine and more particularly to a camshaft drive arrangement most suitable to an outboard motor that has a protective cowling for the engine.

2. Description of Related Art

As is well known, a number of outboard motors, which are expected to produce a large horsepower, are provided with engines having V-shaped banks, each bank involving multiple cylinders. The cylinders are vertically spaced relative to each other and extend generally horizontally. Such a V-shaped configuration is quite suitable to outboard motors because power head of these motors can be small versus their engine powers. In addition to this, conventional outboard motors are mostly powered by two stroke engines. Since the two stroke engines are compact in nature, a power head accommodating this two stroke engine in the V-shaped configuration can be formed as small as possible.

Recently, however, some outboard motors incline to utilize four stroke engines. One reason for this tendency is that emissions of the four stroke engines are clean rather than that of two stroke engines. Generally, however, the four stroke engines have relatively complicated structures as compared with the two stroke engines. Particularly, if the engine is a DOHC (Double Over Head Camshaft drive) engine, it is provided with a relatively large size camshaft drive for activating intake valves and exhaust valves at its cylinder head assembly. This arrangement, thus, gives rise to making the cylinder head assembly be bulky. In addition, camshafts must rotate at a speed half as slow as that of the crankshaft in connection with activating timings of intake and exhaust valves. This means that the diameters of driven wheels such as pulleys or chain sprockets on the camshafts should be twice as large as the diameter of the crankshaft. Accordingly, the cylinder head assembly is likely to be more bulky.

In the meantime, usually a protective cowling encircles the engine in an outboard motor. Thus, the engine is desirable to be as small as possible for contributing to compactness of the outboard motor per se. However, the large driven wheels prevent this desire and the protective cowling tends to be large.

The aforedescribed situations will be described below with reference to a conventional, exemplary four stoke engine shown in FIG. 1.

FIG. 1 illustrates a plan view of the engine 10 and specifically a camshaft drive 12. This engine 10 has V-shaped cylinder banks 14*a,b* each having a few cylinders spaced vertically to each other. Each cylinder bank 14*a,b* has two overhead camshafts 16*a,b* (16*c,d*) disposed vertically for activating intake valves and exhaust valves. Thus, the engine 10 is a DOHC engine. At the bank 14*a*, which is located on the starboard (the left-hand side in the figure), the camshaft 16*b* positioned on the inside has a driven wheel 18 such as a pulley or a chain sprocket at its uppermost end. The camshaft 16*b* also has a driving wheel under the driven wheel 18, although it is not seen. Another camshaft 16*a* has a driven wheel 20 and an endless transmitter 22 such as a cog belt or a chain is wounded around the unseen driving wheel and the driven wheel 20. Meanwhile, the bank 14*b* located on the port side (the right-hand side in the figure) has a similar structure except that the camshaft 16*d* positioned on the outer side has a driven wheel 24.

Further, the engine 10 has a single crankshaft 26 extending vertically in the engine 10 and having a driving wheel 28 at its almost top end. An endless transmitter 30, like the transmitter 22, is wounded around the driving wheel 28 and the respective driven wheels 18, 24 of the camshafts 16*b,d*. With the rotation of the crankshaft 26, thus, the camshafts 16*b,d* are rotated and then the camshafts 16*a,c* are also rotated.

The driven wheels 18, 24 have the diameters twice as large as the diameter of the driving wheel 28. Because the camshafts 16*a,b,c,d* must rotate at a speed that is half as slow as that of the crankshaft in connection with activating timings of the intake and exhaust valves as described above.

On the other hand, although not shown, a protective cowling, which is generally tapered upwardly, encircles the engine 10. The large driven wheels 18, 24, particularly the wheel 24 positioned on the outer side, tend to make the protective cowling be large.

It is, therefore, a principal object of this invention to provide an improved DOHC engine contributing to compactness of an outboard motor accommodating the engine.

It is another object of this invention to provide a DOHC engine for an outboard motor, whereby a camshaft drive does not prevent a protective cowling encircling the engine from being formed compact.

Also, in order to minimize an outboard motor, an arrangement of an air induction system for a DOHC engine is quite important.

It is, therefore, a further object of this invention to provide a DOHC engine wherein an air induction system is arranged properly in view of the minimization of an outboard engine.

SUMMARY OF THE INVENTION

This invention is adapted to be embodied in a four stroke internal combustion engine for an outboard motor having a protective cowling encircling the engine.

In accordance with one aspect of this invention, at least two cylinders forming V-shaped banks are provided. Each cylinder includes a combustion chamber for burning intake charge. An intake valve is also included for admitting the intake charge into the combustion chamber. A first camshaft is further included for activating the intake valve. An exhaust valve is still further included for allowing the burnt charge being discharged from the combustion chamber. A second camshaft is yet further included for activating the exhaust valve. The first and second camshafts are disposed transversely relative to each other and generally vertically. A mechanism is also included for driving one of the first and second camshafts by another one of the first and second camshafts. A piston is reciprocally moved in the cylinder by burning of the intake charge in the combustion chamber. A single crankshaft rotated by the movement of the pistons is provided. The crankshaft is disposed generally vertically and apart from the respective camshafts. The crankshaft has a driving wheel. One of the first and second camshaft positioned on the inside relative to another one of the first and second camshafts in each of the banks has a driven wheel which diameter is larger than a diameter of the driving wheel. An endless transmitter is wound around the driving wheel and the driven wheels so that the driven wheels are driven by the driving wheel when the crankshaft is rotated by the movement of the pistons.

In accordance with another aspect of this invention, at least two cylinders forming V-shaped banks are provided. Each cylinder includes a combustion chamber for burning intake charge. An intake valve is also included for admitting the intake charge into the combustion chamber. A first camshaft is further included for activating the intake valve. An exhaust valve is still further included for allowing the burnt charge being discharged from the combustion chamber. A second camshaft is yet further included for activating the exhaust valve. The first and second camshafts are disposed transversely relative to each other and generally vertically. A mechanism is also included for driving the first and second camshafts. A piston is reciprocally moved in the cylinder by burning of the intake charge in the combustion chamber. At least one intermediate shaft is provided for activating the mechanism. A single crankshaft rotated by the movement of the pistons is provided. The crankshaft is disposed generally vertically and apart from the respective camshafts. The crankshaft has a driving wheel. The intermediate shaft has a driven wheel which diameter is larger than a diameter of the driving wheel. An endless transmitter is wound around the driving wheel and the driven wheel so that the driven wheel is driven by the driving wheel when the crankshaft is rotated by the movement of the pistons.

In accordance with a further aspect of this invention, at least two cylinders forming V-shaped banks are provided. Each cylinder includes a combustion chamber for burning intake charge. An intake valve is also included for admitting the intake charge into the combustion chamber. A first camshaft is further included for activating the intake valve. An exhaust valve is still further included for allowing the burnt charge being discharged from the combustion chamber. A second camshaft is yet further included for activating the exhaust valve. The first and second camshafts are disposed transversely relative to each other and generally vertically. The first camshafts are positioned on each outer side of the respective banks. The second camshafts are positioned on the inside of the respective banks. A piston is reciprocally moved in the cylinder by burning of the intake charge in the combustion chamber. A single crankshaft rotated by the movement of the pistons is provided. The crankshaft is disposed generally vertically and apart from the respective camshafts. A camshaft drive mechanism is provided for driving the first and second camshafts by the crankshaft when the crankshaft is rotated by the movement of the pistons. An air induction system is provided for supplying air that is one component of the intake charge through the intake valves. The air induction system includes at least one air chamber for taking the air from outside of the engine and being disposed apart from the intake valves. At least two delivery conduits are also included each for delivering the air to the combustion chambers. The delivery conduits are disposed at outer sides of the engine.

Further aspects, features and advantages of this invention will be become apparent from the detailed description of the preferred embodiments which follow.

BRIEF DESCRIPTION OF THE DRAWINGS

As noted above.

DETAILED DESCRIPTION OF THE PREFERRED EMBODIMENTS OF THE INVENTION

Figure 3:
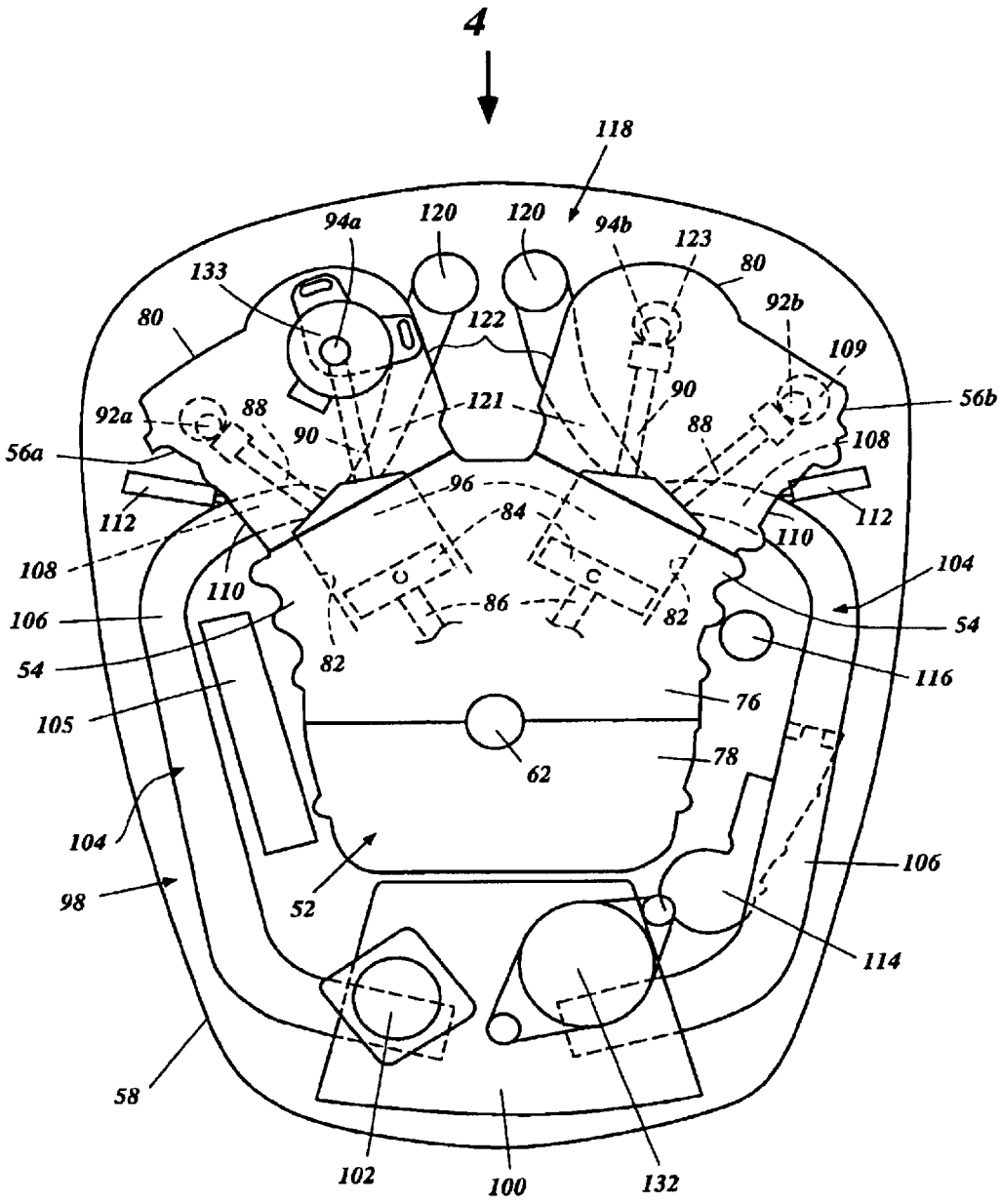
FIG. 3 is a schematic plan view showing the same outboard motor and also engine components disposed therein in a see-through manner.
Figure 4:
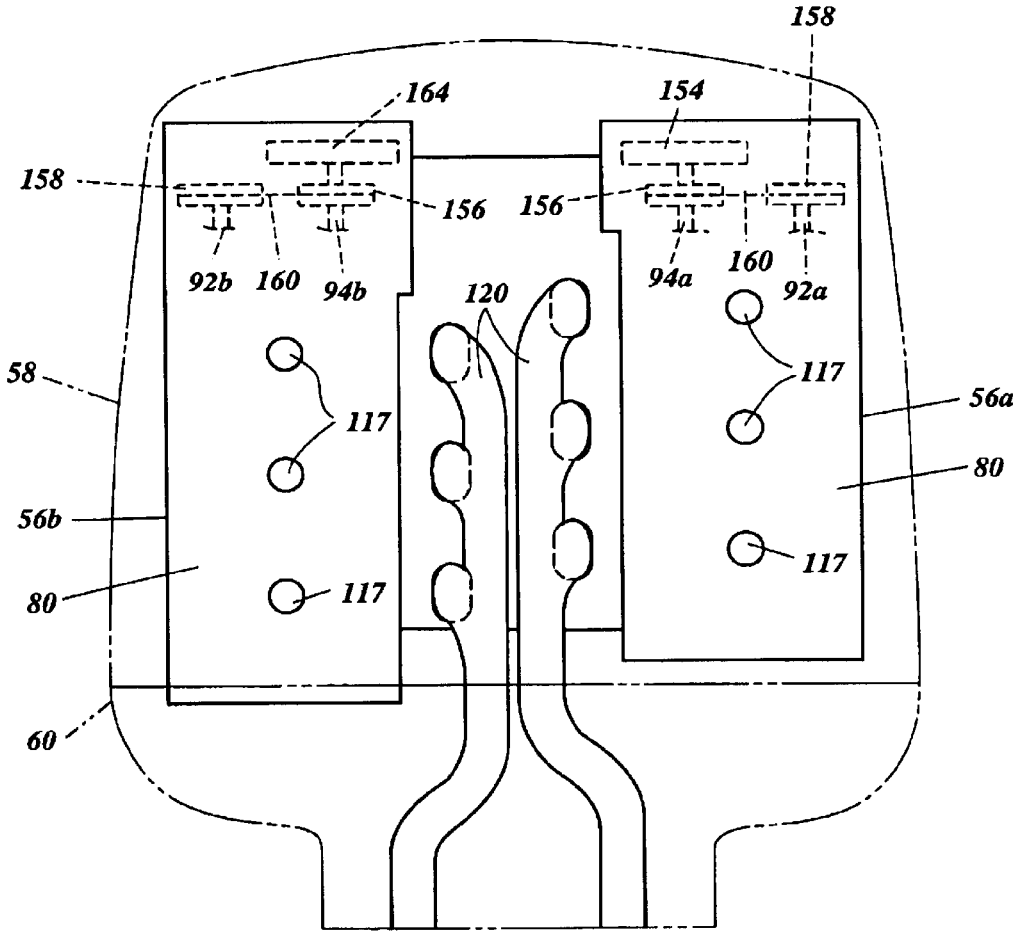
FIG. 4 is a schematic partial rear view showing the same engine components, and is taken in the direction of the arrow 4 in FIG. 3. A protective cowling encircling them is shown in phantom.

At first, the general overall environment of an exemplary outboard motor 40 wherein the invention is practiced will be described primarily with reference to FIGS. 2 through 4.

Figure 1:
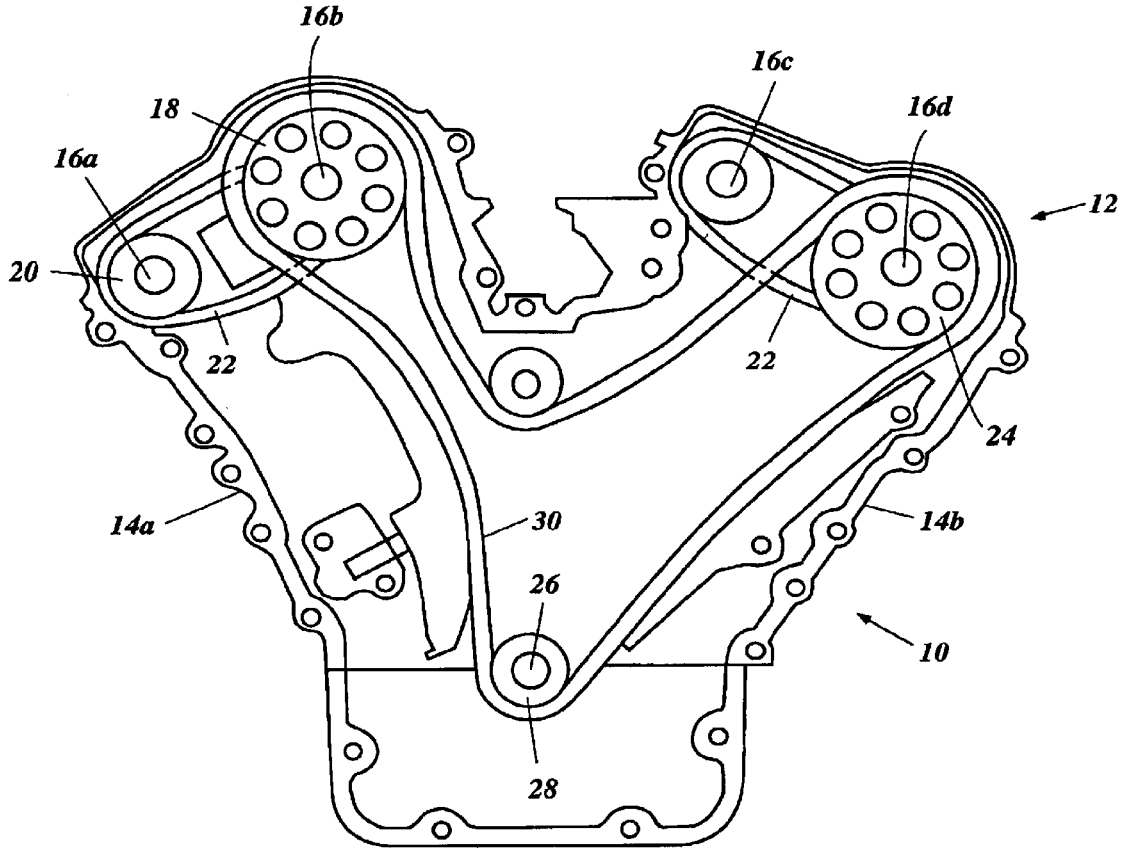
Figure 1 Prior Art
FIG. 1 illustrates a plan view of a conventional, exemplary four stroke engine and specifically a camshaft drive arrangement. This figure is provided in order to assist the reader's understanding of the conventional camshaft drive arrangement in an outboard motor and for the reader to better appreciate the aspects, features and advantages associated with this invention.
Figure 2:
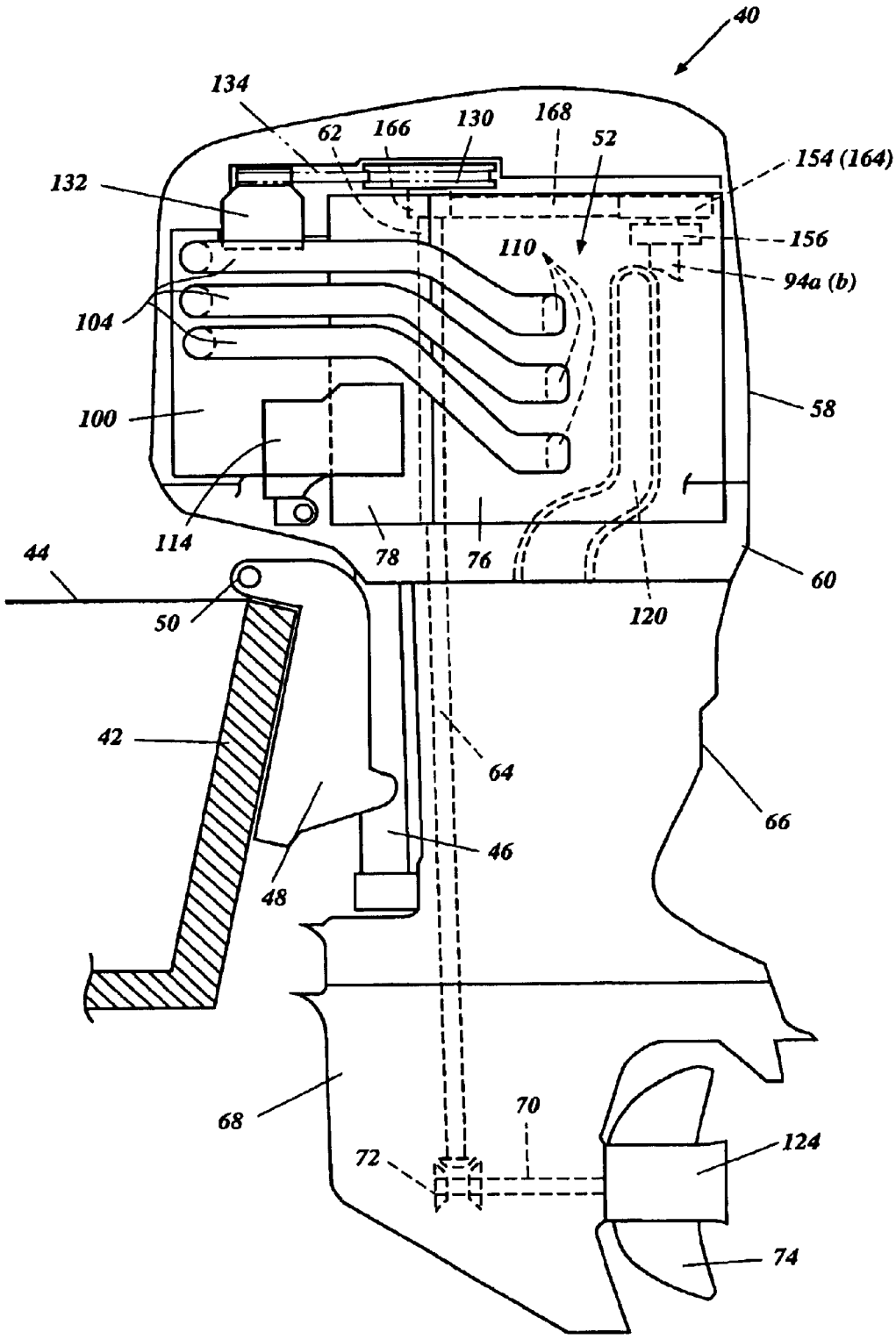
FIG. 2 is a schematic side elevational view showing an outboard motor in which an engine embodying this invention is employed. In this figure, the outboard motor is mounted on an associated watercraft which is partially shown. Also, the engine is shown in a see-through manner.

FIG. 2 schematically illustrates a side elevational view of the outboard motor 40 mounted on an associated watercraft which is partially shown. An engine embodying this invention is shown in a see-through manner. FIG. 3 schematically illustrates a plan view of the same outboard motor to show engine components in a see-through manner. FIG. 4 schematically illustrates a partial rear view of the same outboard motor to show specifically the engine components, and is taken in the direction of the arrow 4 in FIG. 3. A protective cowling encircling them is shown in phantom.

The outboard motor 40 is mounted on a transom 42 of an associated watercraft 44 by a swivel bracket 46 and a cramp bracket 48. The whole body of the outboard motor 40 is pivotally supported around a generally vertically extending axis of the swivel bracket 46 and this connection allows the whole body of the outboard motor 40 to be steered in a suitable manner. Meanwhile, it is also pivotally supported around a horizontally extending axis 50 of the cramp bracket 48 so that its tilting movement and trimming movement are practicable also.

The outboard motor 40 includes a powering internal combustion engine 52. This engine 52 operates on a four stroke principle and has six cylinders 54 which are divided evenly to form V-shaped banks 56*a,b*. That is, each bank 56*a,b* has three cylinders 54. The three cylinders 54 in each bank 56*a,b* are spaced vertically. The engine 52 is encircled with a top cowling 58 and a bottom cowling 60 both forming a protective cowling. The reference numeral 58 will represent the protective cowling also in the following description. The top cowling 58 is tapered upwardly as seen in both of the side view (FIG. 2) and the rear view (FIG. 4). In other words, the upper portion of the top cowling 58 is narrower than the lower portion thereof. Also, the top cowling 58 is detachably affixed to the bottom cowling 60 so as to ensure access to the engine 46 for maintenance.

The engine 52 has a crankshaft 62 extending generally vertically. A driveshaft 64 continues from the crankshaft 62 and extends vertically and downwardly in an upper housing 66 and also a lower housing 68. The bottom end of the driveshaft 64 is connected with a propeller shaft 70 by means of a bevel gear 72. This propeller shaft 70 extends generally horizontally and a propeller 74 is affixed at the end of the propeller shaft 70. Through the crankshaft 62, driveshaft 64, the bevel gear 72 and the propeller shaft 70, the engine 52 powers the propeller 74.

The engine 52 generally comprises a cylinder block 76, a crankcase 78 and a cylinder head assembly 80. The cylinder block 76 contains the six cylinders 54 therein. Each cylinder 54 has a cylinder bore 82 in which a piston 84 reciprocates. The piston 84 is connected to the crankshaft 62 via a connecting rod 86 so that the reciprocal movement of the piston 84 rotates the crankshaft 62. The cylinder head assembly 80 comprises a cylinder head and a cylinder head cover and contains intake valves 88, exhaust valves 90, an intake camshaft 92*a*(*b*) and an exhaust camshaft 94*a*(*b*). Thus, the engine 52 is a DOHC engine. The intake camshaft 92*a,b* and the exhaust camshaft 94*a,b* are provided for activating the intake valves 88 and the exhaust valves 90, respectively. Valve heads of the intake valves 88 and the exhaust valves 90 are omitted and only valve stems are shown in the figures.

The cylinder bore 82, the piston 84, the cylinder head assembly 80 including the valve heads of the intake valves 88 and the exhaust valves 90 generally define a combustion chamber 96 for burning intake charge which is mixture of air and fuel.

The engine 52 has an air induction system 98 for supplying air that is one component of the intake charge. The air induction system 98 includes a surge tank or air chamber 100 placed in front of the engine 52 in the protective cowling 58 and a throttle body 102 mounted on the surge tank 100. The throttle body 102 contains a throttle valve (not shown) that can be operated by the operator with a throttle lever provided on a steering handle (not shown). Air charge can be taken into the surge tank 100 through the throttle body 102 by opening the throttle valve. The surge tank 100 can smooth off the air charge because of its relatively large volume.

The air induction system 98 completed with a plurality of delivery conduits 104 placed between the surge tank 100 and the combustion chambers 96. Each delivery conduit 104 comprises an intake duct 106 and an intake passage 108 formed in the cylinder head assembly 80. The intake valves 88 open and close intake ports located at the most downstream of the intake passages 108 when activated by cams 109 of the intake camshafts 88. The intake ducts 106 are laid along both of outer walls of the engine 52 and connected to the inner passages 108 at intake openings 110. Since the intake ducts 106 extend like this, each length can be relatively long. Such a relatively long intake duct can contribute in improvement of engine characteristics at a low and/or middle speed range, particularly the torque characteristic.

Although the engine 52 is provided with the single surge tank 100 in this arrangement, two or more surge tanks may replace it.

Fuel injectors 112 are affixed to the respective delivery conduits 104 in the proximity of the intake openings 110. The fuel injectors 112 are included in a fuel supply system. The fuel supply system includes, in addition to the fuel injectors 112, a fuel supply tank (not shown) located in the associated watercraft 44, a vapor separator 114 and a high pressure fuel delivery pump 116. The fuel injectors 112 spray fuel, which is another component of the mixture or intake charge, into the delivery conduits 104 under control of a computerized control device 105 which is affixed on the starboard side engine wall.

A firing system is provided, although it is not shown, for firing the intake charge in the combustion chambers 96. The firing system includes spark plugs that are affixed at openings 117 of the cylinder head assembly 80 so that firing electrodes are exposed to the combustion chambers 96. Firing timings of the spark plugs are also controlled by the aforenoted control device 105.

The engine 52 has also an exhaust system 118. The exhaust system 118 is provided for conveying burnt charge or exhaust gasses from the combustion chambers 96 and discharge outside of the engine 52. More specifically, the exhaust system 118 includes a pair of exhaust manifolds 120 to collect the exhaust gasses from respective exhaust passages 121 that are formed in the cylinder head assembly 80 and connected to the respective combustion chambers 96 via the exhaust valves 90. The exhaust manifolds 120 are connected to the exhaust passages 121 at exhaust openings 122. The exhaust valves 90 open and close exhaust ports located at the most upstream of the exhaust passages 121 when activated by cams 123 of the exhaust camshafts 94. The collected exhaust gasses, then, flow exhaust conduits (not shown) in the upper housing 66 and lower housing 68 and are finally discharged to the body of water surrounding the outboard motor 40 through a boss 124 of the propeller 74.

The crankshaft 62 protrudes upwardly from the engine 52 and a flywheel 130 is affixed at the top of the crankshaft 62. Meanwhile, an alternator 132 is mounted on the surge tank 100 and a belt 134 is wounded around the shaft of the alternator 132 and the flywheel 130 so that the alternator 132 rotates with the rotation of the crankshaft 62. The alternator 132 generates electric power and supplies the power to the control unit 105, spark plugs, a battery (not shown) and other parts which need it.

The exhaust camshaft 94*a* protrudes upwardly outside of the cylinder head assembly 80 and a camshaft sensor 133 is mounted at the top end of this camshaft 94*a*. The camshaft sensor 133 senses angles and rotational speeds of the camshaft 94*a* and sends signals to the control device 105. The control device 105, then, determines if the camshaft drive keeps normal timings that the intake valves 88 and the exhaust valves 90 require.

Figure 5:
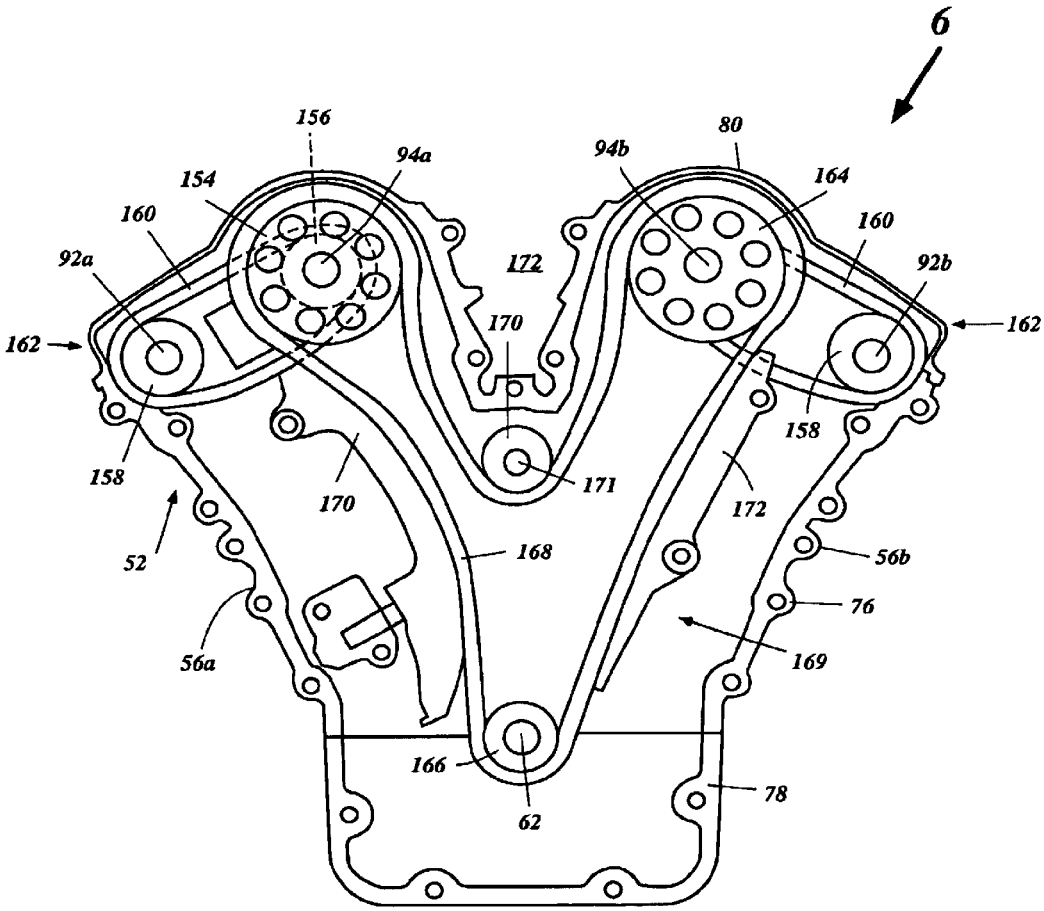
FIG. 5 is a schematic plan view of the same engine and specifically showing a camshaft drive arrangement.
Figure 6:
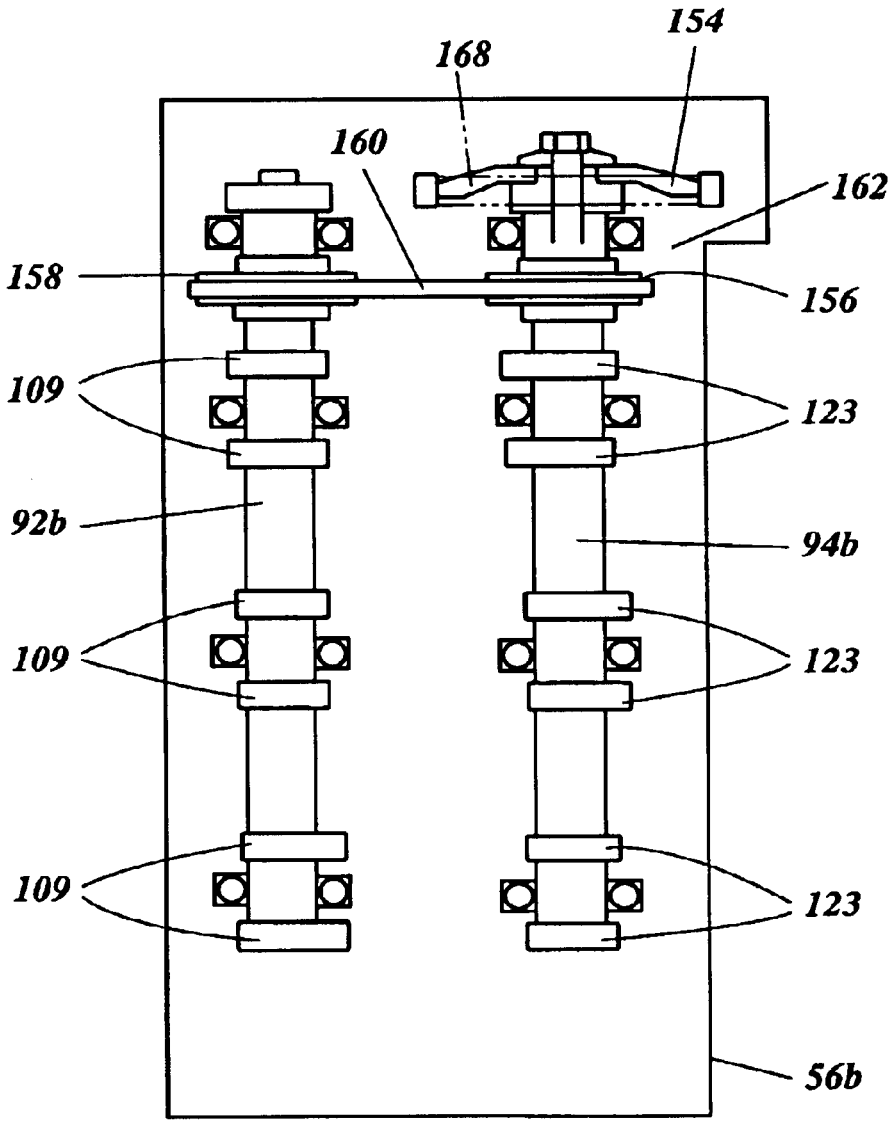
FIG. 6 is a schematic side elevational view of a part of the camshaft drive that positioned on the starboard side bank, and is taken in the direction of the arrow 6 in FIG. 5.

Referring now primarily to FIGS. 5 and 6 and additionally to FIGS. 2 through 4, one preferred embodiment of this invention will be described below.

FIG. 5 illustrates a plan view of the engine 52 and specifically a camshaft drive arrangement. FIG. 6 illustrates a side elevational view of a part of the camshaft drive 150 that positioned on the starboard side bank 56*a*, and taken in the direction of the arrow 6 in FIG. 5.

As described above, each cylinder bank 56*a,b* has the two camshafts 92*a*, 94*a* (92*b*, 94*b*) disposed vertically for activating the intake valves 88 and exhaust valves 90, respectively. At the bank 56*a* which is located on the starboard (the left-hand side in the figure), the camshaft 94*a* positioned on the inside has a chain sprocket 154 as a driven wheel at its uppermost end. The camshaft 94*a* also has a chain sprocket 156 as a driving wheel under the driven wheel 154 and another camshaft 92*a* also has a chain sprocket 158 as a driven wheel. Diameters of the both driven wheels 156,158 are the same as each other. A chain 160 as an endless transmitter is wounded around the driving wheel 156 and the driven wheel 156. The driving wheel 156, the driven wheel 158 and the endless transmitter 160 form a secondary drive mechanism 162. The secondary drive mechanism 162 may have a couple of gears instead of the combination of the driving wheel 156 and the driven wheel 158. The endless transmitter 160 is no longer necessary in this variation.

Meanwhile, the bank 56*b* located on the port side (the right-hand side in the figure) has a similar structure. That is, the camshaft 94*b* positioned on the inside has a driven wheel 164.

The crankshaft 62 has a driving wheel 166 directly below the flywheel 130. A timing chain 168 as an endless transmitter 168 is wounded around the driving wheel 166 and the respective driven wheels 154, 164 of the camshafts 94*a,b*. The driven wheels 154,164 and the endless transmitter 168 form a primary drive mechanism 169. The driven wheels 154, 164 have diameters generally twice as large as a diameter of the driving wheel 166.

An idler wheel 170 is provided on an idler shaft 171 positioned between the driven wheels 154 and 156 to bring the endless transmitter 168 close to the driving wheel 166. Because of this, a ravine 172 between both of the banks 56*a,b* can be deep and space for the exhaust system 118 will be large. In addition, overlap area of the endless transmitter 168 on the driven wheels 154, 156 becomes greater. This ensures transmission of driving force.

Also, a chain tensioner assembly 170 and a guide member 172 are provided along the timing chain 168 for adjusting tension thereof. Although, this chain tensioner assembly 170 is operated hydraulically, a mechanism utilizing spring force is also applicable.

With the rotation of the crankshaft 26, the endless transmitter 168 moves to rotate the driven wheels 154,164 in the primary drive mechanism 169. Thus, the camshafts 94*a,b* are rotated and then the camshafts 92*a,b* are also rotated by the endless transmitters 160 in the secondary drive mechanism 162. The rotational speeds of the camshafts 92*a,b* and 94*a,b* are half as slow as the rotational speed of the crankshaft 62 because the diameters of the driven wheels 154,164 are twice as large as the diameter of the driving wheel 166.

As seen in FIG. 6, the intake camshaft 92*b* has the pair of intake cams 109 for each combustion chambers 96 and hence totally six intake cams 109, while the exhaust camshaft 94*b* has the pair of exhaust cams 123 for each combustion chambers 96 and hence totally six exhaust cams 123 also. The camshafts 92*a*, 94*a* on the other bank 56*a* have the same number of cams as the camshafts 92*b*, 94*b*.

Figure 7:
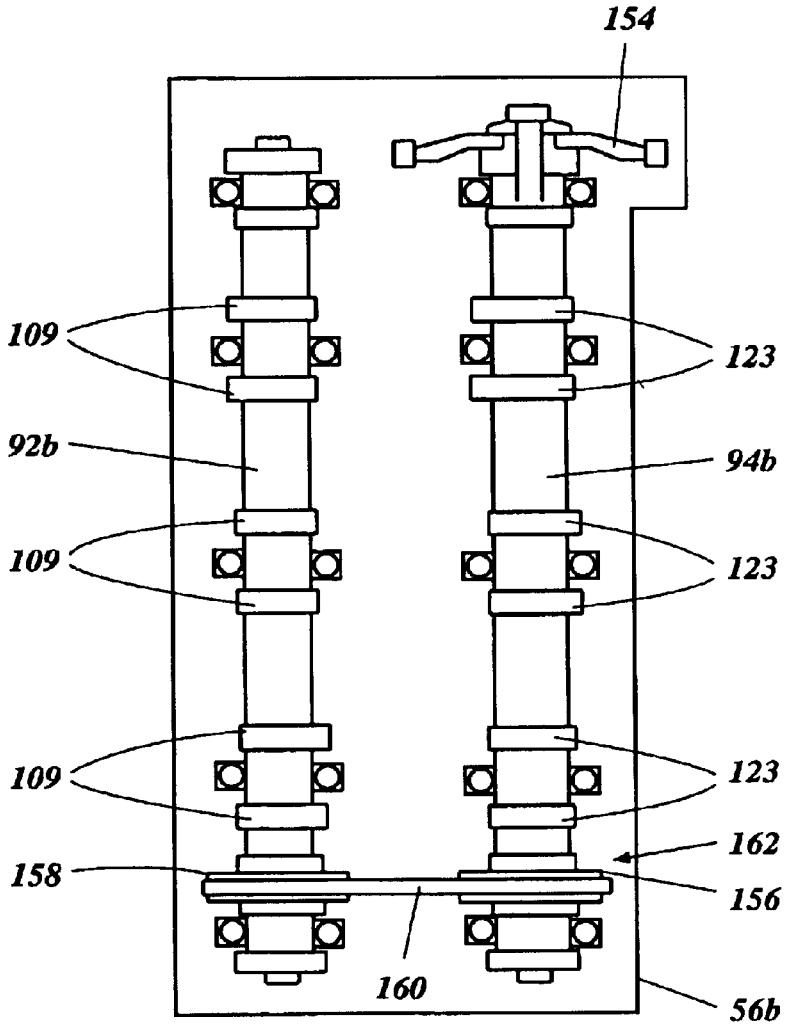
FIG. 7 is a variation of the arrangement shown in FIG. 6.

FIG. 7 illustrates a variation of the arrangement. In this variation, the secondary drive mechanism 162 is placed at almost the bottom ends of the camshafts 92*b*, 94*b*. The camshafts 92*a*, 94*a* on the other bank 56*a* have the same arrangement also.

As described above, both of the driven wheels 154,156, which have the relatively large diameter, in the camshaft drive arrangements including the variations are positioned on the inside of the banks 56*a,b*. Accordingly, no protrusion is made laterally and hence the engine 52 can be compact. Also, the arrangement shown in FIG. 7 can minimize the engine 52 much more.

Figure 8:
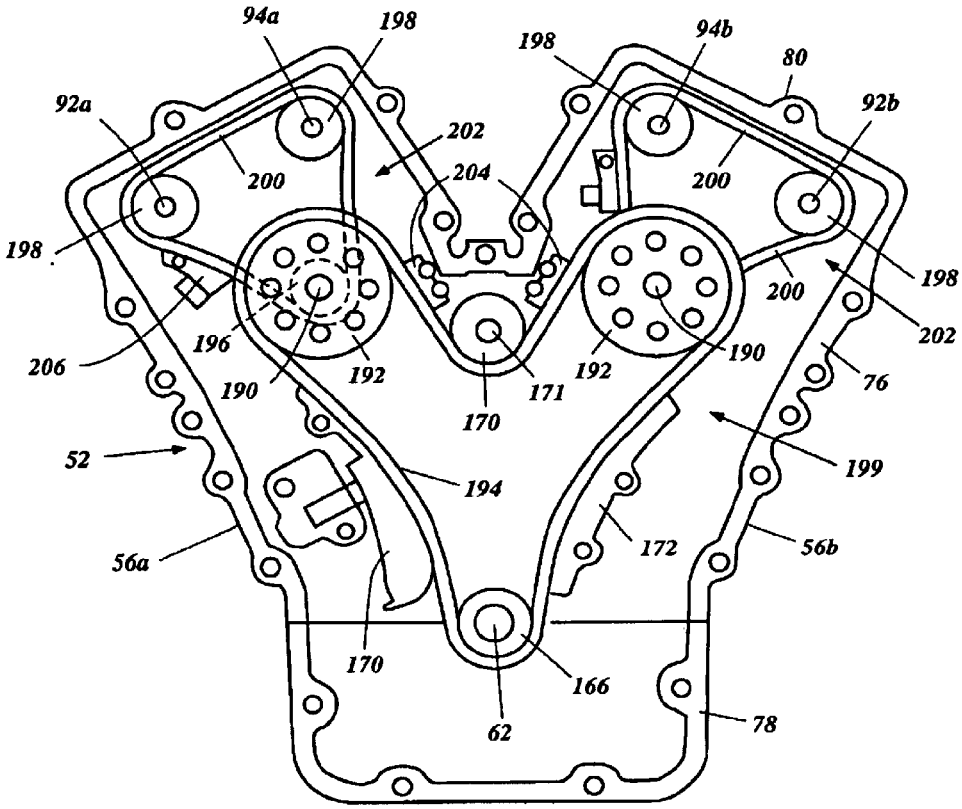
FIG. 8 is a schematic plan view of an engine embodying another arrangement of the camshaft drive.
Figure 9:
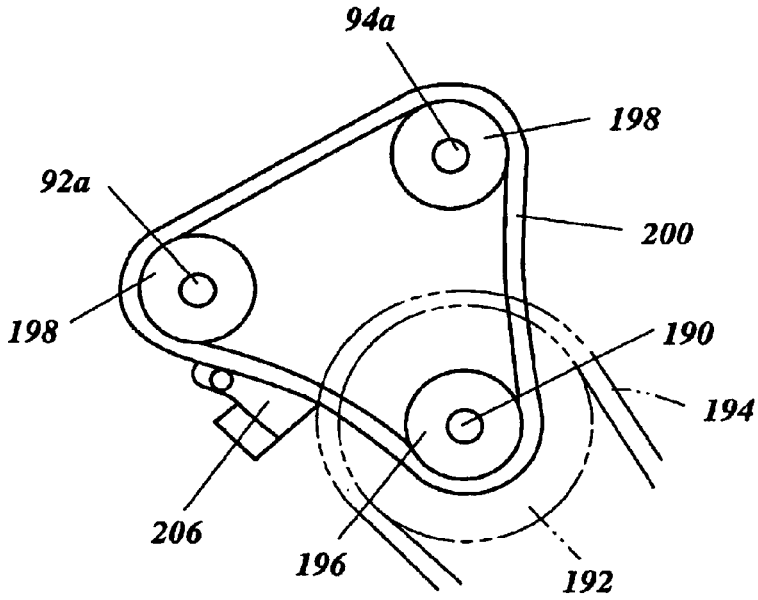
FIG. 9 is an enlarged partial plan view specifically showing a secondary drive mechanism of the camshaft drive shown in FIG. 8 and formed with a chain and sprockets.

FIGS. 8 and 9 illustrate another embodiment of this invention. FIG. 8 is a plan view of an engine embodying this camshaft drive. FIG. 9 is an enlarged partial side view specifically showing a secondary drive mechanism of the camshaft drive shown in FIG. 8. The components and members already shown in FIGS. 2 through 7 are assigned with the same reference numbers and no descriptions will be given for avoiding redundancy.

As aforedecribed, in the embodiment shown in FIGS. 2 through 7, either one of the camshafts 92*a,b* and 94*a,b* on the respective banks 56*a,b* are directly driven by the crankshaft 62. However, in this embodiment, intermediate shafts 190 are provided between the camshafts 92*a,b* and 94*a,b* and the crankshaft 62. Chain sprockets 192 as driven wheels are affixed on the intermediate shafts 190 and a timing chain 194 is wound around the driving wheel 166 and the driven wheels 192. Like the first embodiment, the driven wheels 192 have a diameter that is twice as large as the diameter of the driving wheel 166.

There are chain sprockets 196, as driving wheels, directly below the driven wheels 192 on the intermediate shafts 190. Also, chain sprockets 198 are affixed on the respective camshafts 92*a,b* and 94*a,b*. All diameters of the driving wheels 196 and the driven wheels 198 are the same. Chains 200, as endless transmitters, are wound around the driving wheels 196 and driven wheels 198. The combination of the driving wheel 166, driven wheels 192 and the endless transmitter 194 form a primary drive mechanism 199, while the combination of the driving wheel 196, driven wheels 198 and the endless transmitter 200 forms a secondary drive mechanism 202 in this arrangement.

A pair of guide members 204 are provided in the proximity of the idler wheel 170 and between the idler wheel 170 and the driven wheels 192 in addition to the guide member 172. Also, chain tensioners 206 are provided at the respective chains 200 of the secondary drive mechanism 202.

The crankshaft 62 rotates the intermediate shafts 190 by the endless transmitter 194 wound around the driving wheel 166 and the driven wheels 192 in the primary drive mechanism 199. Then, the respective intermediate shafts 190 rotate the corresponding camshafts 92*a,b* and 94*a,b* in the respective secondary drive mechanisms 202. In this embodiment, the rotational speeds of the camshafts 92*a,b* and 94*a,b* are also half as slow as the rotational speed of the crankshaft 62.

As described above, this arrangement employs the intermediate shafts 190 and driven wheels 192 located on the intermediate shafts 190. Accordingly, the relatively large driven wheels 192 are positioned rather inside of the engine 52 and no protrusion is made laterally. This arrangement, thus, makes the engine 52 compact also.

Also, this arrangement allows making the diameter of the driven wheels 192 smaller than the double size of the diameter of the driving wheel 166. That is, if the respective diameters of the driving wheel 166, the driven wheels 192, the driving wheels 196 and the driven wheels 198 are R1, R2, R3 and R4, respectively, the relationships among them are as follows;

$$R2/R1 \times R4/R3 = 2$$

This formula means that if the ratio of the diameter R4 versus the diameter R3 is greater than "1", then the ratio of the diameter R2 versus the diameter R1 can be smaller than "2". For example, if the diameter R4 is as 1.2 times as greater than the diameter R3, then the diameter R2 will be as approximately 1.7 times as greater than the diameter R1. Accordingly, the driven wheels 192 can be furthermore smaller and so is the engine 52 per se.

Figure 10:
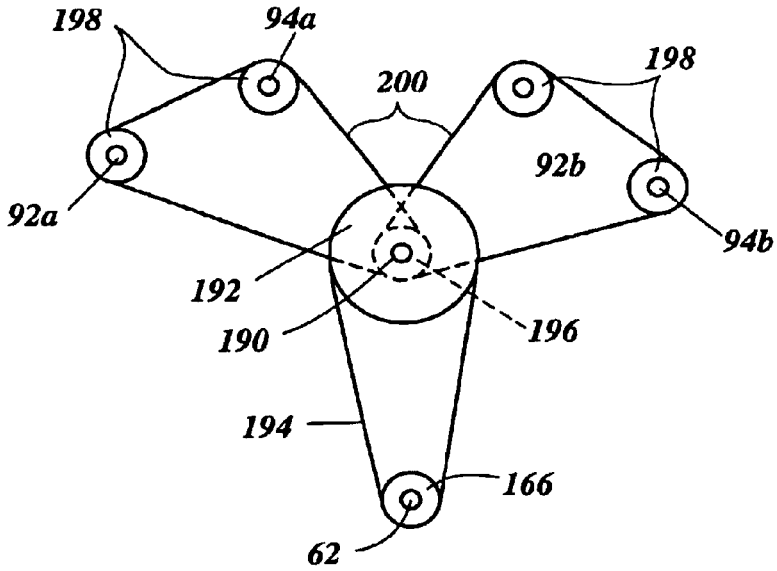
FIG. 10 is a schematic plan view showing an arrangement in variation.

It should be noted that a common intermediate shaft 190 can replace the two intermediate shafts 190 as shown in FIG. 10. In this variation, the common intermediate shaft 190 has a single driven wheel 192 and a pair of driving wheels 196. The respective endless transmitters 200 are wound around the respective driving wheels 196 and the driven wheels 198.

Figure 11:
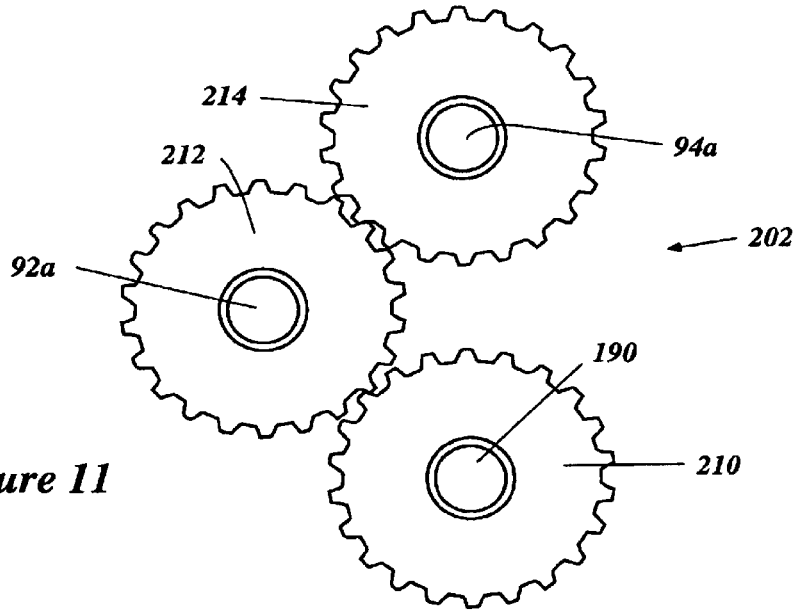
FIG. 11 is a partial plan view showing a combination of three gears instead of the chain and sprockets combination as the secondary drive mechanism.
Figure 12:
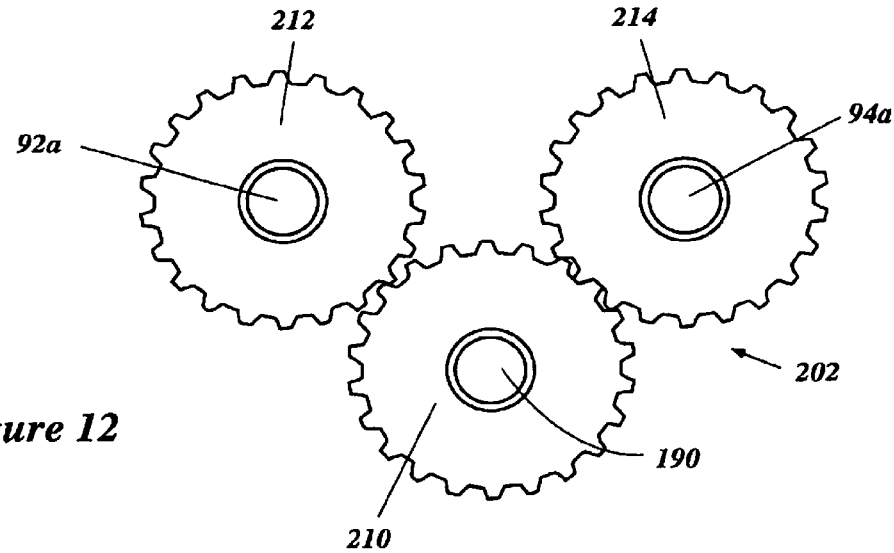
FIG. 12 is a partial plan view also showing another combination of the three gears.
Figure 13:
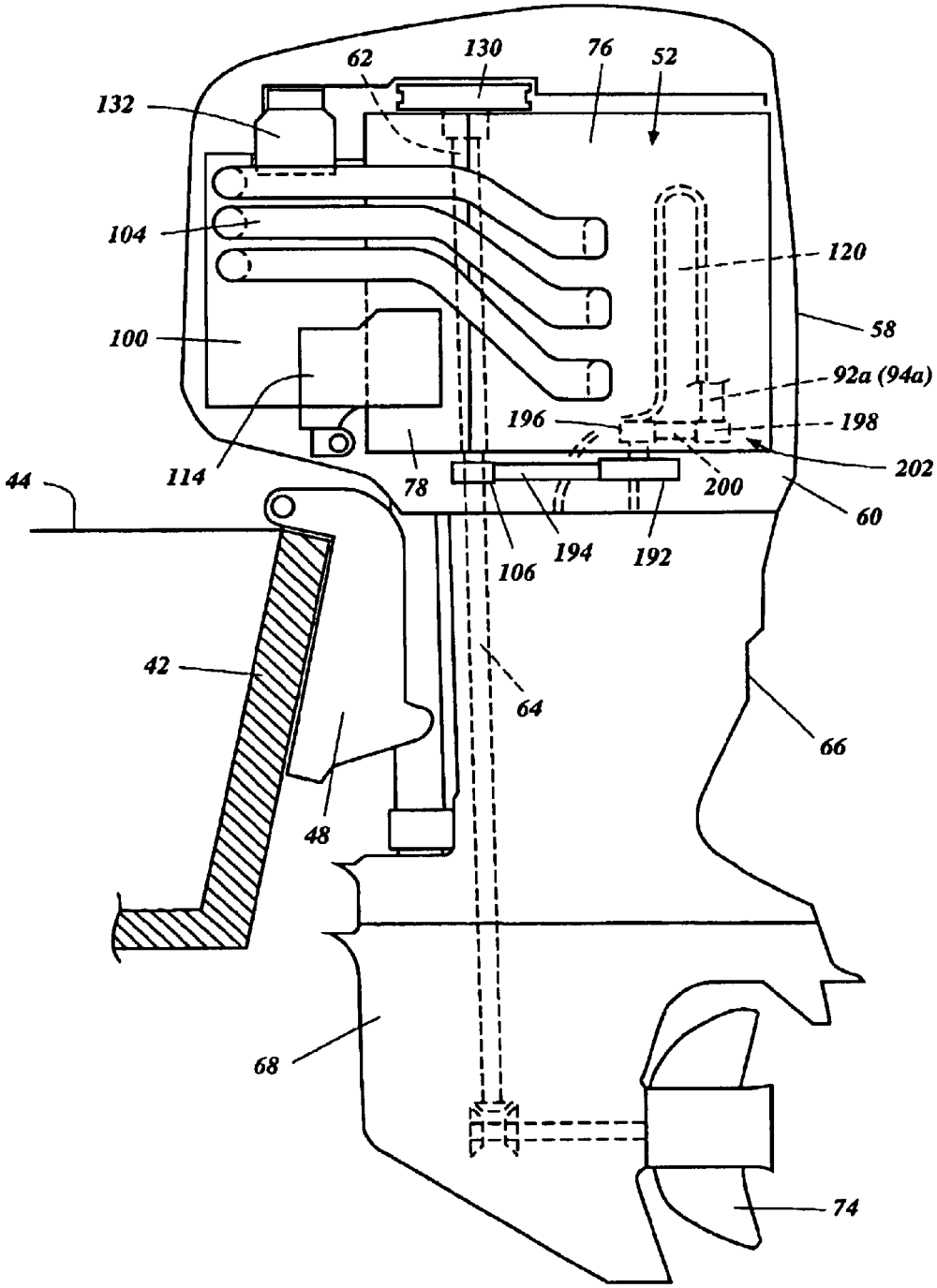
FIG. 13 is a schematic side elevational view showing an outboard motor embodying a further arrangement therein.

FIGS. 11 and 12 illustrate still other embodiments in which gear combinations are used instead of the sprocket and chain combination as the secondary drive mechanism 202. FIG. 11 is a partial plan view showing a combination of three gears. FIG. 12 is a partial plan view also showing another combination of three gears.

In FIG. 11, gears 210, 212 and 214 are affixed on the intermediate shaft 190 and camshafts 92*a* and 94*a*, respectively. The gear 212 on the camshaft 92*a* is meshed with the gear 210 on the intermediate shaft 190 and then the gear 214 on the camshaft 94*a* is meshed with the gear 212. Thus, the gear 212 is directly rotated by the gear 210, while the gear 214 is indirectly rotated by the gear 210 via the gear 212. Also, in FIG. 12, since both of the gears 212 and 214 on the camshafts 92*a* and 94*a* are meshed with the gear 210 on the intermediate shaft 190, both of the gears 212 are directly rotated by the gear 210.

In both arrangements, The diameters of the three gears 210, 212 and 214 are the same as each other. However, it is of course possible to make the diameters of the gears 212 and 214, which are still the same as each other, smaller than the diameter of the gear 210 in the same theory as described with the embodiment shown in FIGS. 8 and 9.

The arrangements using gear combinations can make the secondary drive mechanism 202 more compact and contribute minimizing the engine 52 again.

FIG. 12 illustrates a side elevational view showing an outboard motor embodying a further arrangement therein.

In this figure, like the arrangement shown in FIG. 7, the driving wheel 106 is placed at the bottom end of the crankshaft 62. The intermediate shaft 190 is also lowered. The driven wheels 192, the endless transmitter 194 and further the secondary drive mechanism 202 including the driving wheels 196 and driven wheels 198 are lowered as well. The secondary drive mechanism 202 may of course have the gear combinations shown in FIGS. 10 and 11 as variations. Thus, like the arrangement shown in FIG. 7, no protrusion is made laterally in this arrangement and the engine 52 can be more compact again.

In the embodiments and variations, driving wheels and driven wheels can be replaced with pulleys and the endless transmitter will be a cog belt in this replacement.

Also, the contrary valve arrangement is applicable, in which the intake valves 88 are on the inside and the exhaust valves 90 are on the outer side at each banks 56*a,b*, unless clearly recited otherwise in the following claims.

It should be further noted that the engine 52 may have other numbers of cylinders such as four and eight other than six.

Of course, the foregoing description is that of preferred embodiments of the invention, and various changes and modifications may be made without departing from the spirit and scope of the invention, as defined by the appended claims.

What is claimed is:

1. A four stroke internal combustion engine for an outboard motor comprising a cylinder block defining a first bank and a second bank with at least one cylinder bore defined in each cylinder bank, the cylinder bores extending generally horizontally, pistons reciprocating in the respective cylinder bores, cylinder head assemblies affixed to the cylinder block to define combustion chambers together with the cylinder bores and the pistons, a crankshaft coupled with the pistons, at least one intake valve cooperating with each one of the cylinder bores to admit an air charge into each one of the combustion chambers, a first intake camshaft actuating the intake valve of the first bank, a second intake camshaft actuating the intake valve of the second bank, at least one exhaust valve cooperating with each one of the cylinder bores to discharge burnt charge from each one of the combustion chambers, a first exhaust camshaft actuating the exhaust valve of the first bank, a second exhaust camshaft actuating the exhaust valve of the second bank, one of the first intake and exhaust camshafts and one of the second intake and exhaust camshafts being driven by the crankshaft through a primary transmitter, a first transmitter coupling the first intake and exhaust camshafts together such that the one first intake or exhaust camshaft, which is driven by the primary transmitter, drives the other one of the first intake and exhaust camshafts, and a second transmitter coupling the second intake and exhaust camshafts together such that the one second intake or exhaust camshaft, which is driven by the primary transmitter, drives the other one of the second intake and exhaust camshafts, the primary transmitter being disposed on one side of the cylinder block, the first and second transmitters being disposed on another side of the cylinder block, the one side and the another side of the cylinder block being separated by the cylinder bores.

2. The engine as set forth in claim 1, wherein the primary transmitter is disposed on the upper side of the cylinder block, and the first and second transmitters are disposed on the lower side of the cylinder block.

3. The engine as set forth in claim 1, wherein the crankshaft through the primary transmitter drives the first and second exhaust camshafts.

4. The engine as set forth in claim 3, wherein the first intake camshaft is driven by the first exhaust camshaft, and the second intake camshaft is driven by the second exhaust camshaft.

5. The engine as set forth in claim 1, wherein the first and second exhaust camshafts are disposed next to each other.

6. The engine as set forth in claim 1, wherein the primary transmitter includes a belt or a chain.

7. The engine as set forth in claim 1, wherein the first transmitter includes a belt or a chain.

8. The engine as set forth in claim 1, wherein the second transmitter includes a belt or a chain.

9. The engine as set forth in claim 1, wherein the first and second banks each include a plurality of cylinder bores spaced apart from one another vertically, and all of the cylinder bores of the first and second bank lie between the one side and the another side of the cylinder block.

* * * * *